US008069511B1

(12) United States Patent
DiMucci

(10) Patent No.: US 8,069,511 B1
(45) Date of Patent: Dec. 6, 2011

(54) POWERED EMERGENCY MEDICAL TRANSPORTER

(76) Inventor: Vito A. DiMucci, Saratoga, CA (US)

( * ) Notice: Subject to any disclaimer, the term of this patent is extended or adjusted under 35 U.S.C. 154(b) by 0 days.

(21) Appl. No.: 11/497,869

(22) Filed: Aug. 1, 2006

(51) Int. Cl.
*A47B 7/00* (2006.01)

(52) U.S. Cl. ..... 5/611; 5/11

(58) Field of Classification Search ..... 5/616, 611, 5/600; 182/141; 318/260
See application file for complete search history.

(56) References Cited

U.S. PATENT DOCUMENTS 2,833,587 A * 5/1958 Saunders ..... 296/20
5,495,914 A 3/1996 DiMucci et al.
5,697,471 A 12/1997 DiMucci et al.
5,740,884 A 4/1998 DiMucci et al.
5,887,302 A 3/1999 DiMucci et al.
5,983,425 A * 11/1999 DiMucci et al. ..... 5/611
6,226,193 B1 * 5/2001 Bayer et al. ..... 363/59
6,915,538 B2 * 7/2005 Treon ..... 5/611

OTHER PUBLICATIONS

"Smoothing" by Tim Surtell as archived by archive.org on Aug. 9, 2003. See http://web.archive.org/web/20030809235504/http://www.eleinmec.com/article.asp?19.*
Catalog No. 94: Ball Screws, Acme Screws, Actuators, Linear Guides, Bearing Units, Couplings, Supernuts, Anti-Backlash Nuts. Power Trac Design Guide, 1992 Nook Industries, Inc.

* cited by examiner

*Primary Examiner* — Michael Trettel
*Assistant Examiner* — William Kelleher
(74) *Attorney, Agent, or Firm* — Haynes and Boone, LLP

(57) ABSTRACT

A gurney includes a platform connected to a frame by two pairs of X-connected arms configured to reduce the amount of power required to raise the platform from its lowest position relative to the frame. A voltage doubling circuit is provided to approximately double the voltage applied to the motor to allow the platform to be raised and lowered relatively faster than normal. A rotating shaft in an internally threaded nut moves a cross beam to raise or lower the platform. The nut has interior bearings to reduce the friction between the shaft and the nut. A detent mechanism and a brake structure provide fail-safe locking of the platform at a plurality of heights.

6 Claims, 10 Drawing Sheets

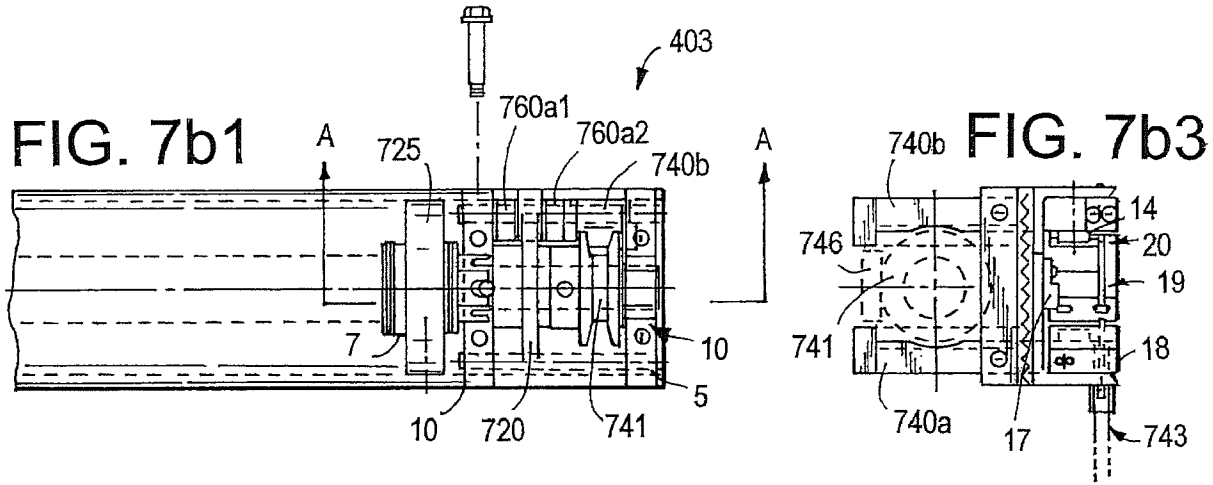
FIG. 7b1
FIG. 7b3
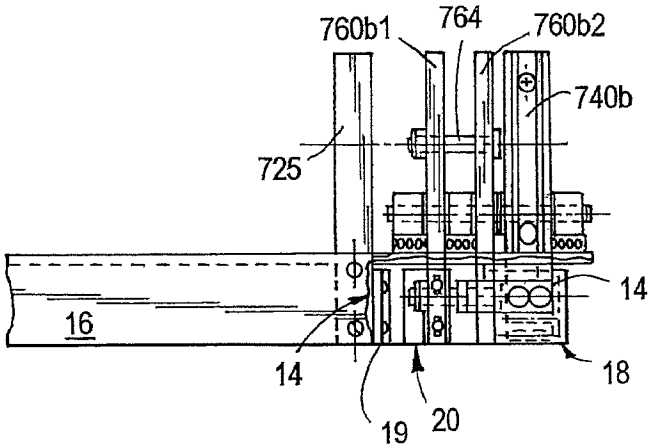
FIG. 7b2
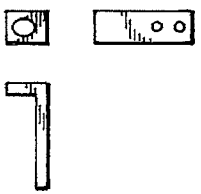
FIG. 7b4

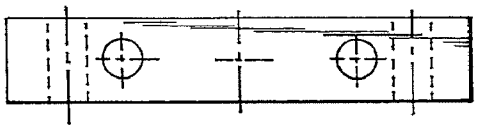
FIG. 7c2
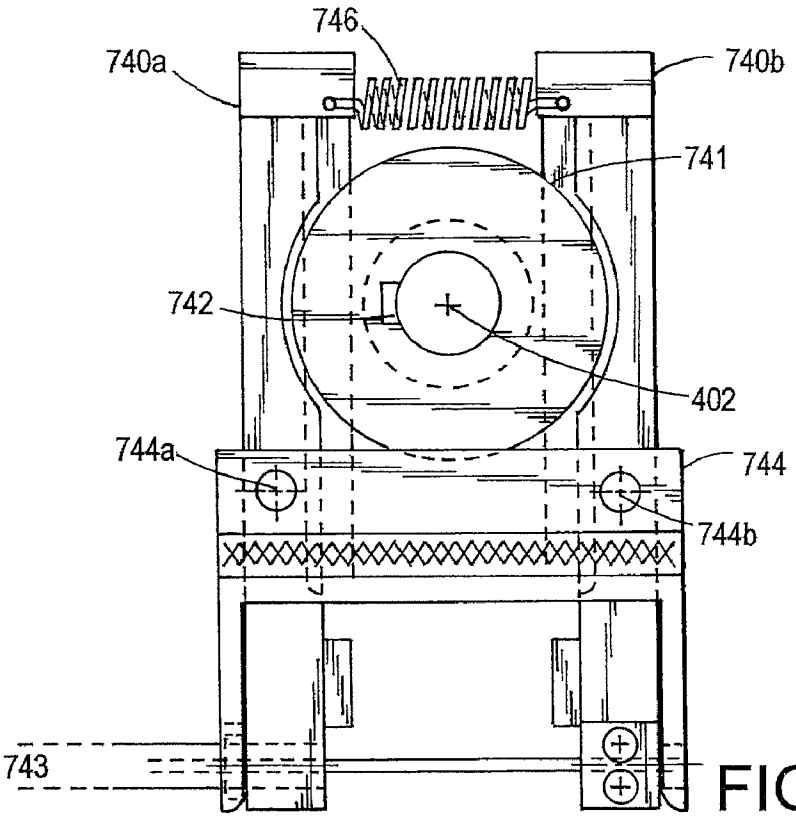
FIG. 7c1

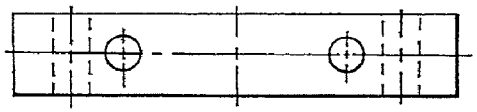
FIG. 7d2
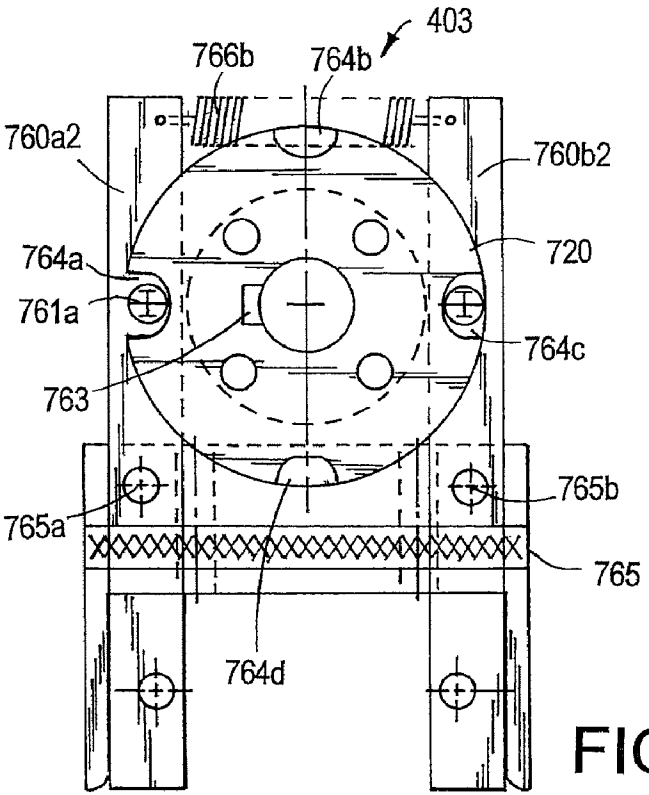
FIG. 7d1

POWERED EMERGENCY MEDICAL TRANSPORTER

FIELD OF THE INVENTION

This invention relates to a powered emergency medical transporter (also called a gurney) for transporting a patient from one location to another and in particular to an improved transporter which is capable of being efficiently powered up and down at one or more speeds.

BACKGROUND OF THE INVENTION

Power-assisted gurneys capable of transporting a patient from either the scene of an accident or from one facility to another facility, are described in U.S. Pat. Nos. 5,495,914, 5,697,471, 5,740,884, 5,887,302 and 5,983,425, all including as a co-inventor the inventor of this disclosure. Each of these patents is hereby incorporated by reference in its entirely. These patents describe various techniques for allowing the power lifting unit to raise or lower the transporter and also describe electronic controls which allow a single operator to operate the transporter. In addition, U.S. Pat. No. 5,983,425 discloses a structure which allows an electric motor to be engaged to assist in raising or lowering the transporter and disengaged to allow the transporter to be raised or lowered manually. U.S. Pat. No. 5,887,302 describes a circuit for controlling an electric motor used to raise or lower the gurney as well as to provide a jog pulse to the electric motor.

A continuing problem associated with battery-operated raisable or lowerable gurneys is the requirement that the battery associated with the drive motor used to raise or lower the gurney have both a long life and be light weight. These two requirements conflict. Thus, there is a need for a more efficient, lighter structure for raising and lowering a battery-powered gurney to extend battery life and to lower the weight of the total gurney.

SUMMARY OF THE INVENTION

In accordance with this invention, a gurney (sometimes called a powered emergency medical transporter or "PwEMT") is provided which improves the efficiency of powering up and down the gurney and specifically includes a structure which assures maximum leverage and efficiency for raising the gurney from the lowest level position of the gurney.

In one embodiment, a unitary power unit powers the up and down motion of the PwEMT. The power unit is specifically designed with a unique in-line force-to-load scheme that results in high efficiency and thereby enables maximum efficient power transfer to raise and lower the cot portion (i.e. the platform on which a patient is placed) of the gurney.

In another embodiment, a lightweight brake and locking mechanism is integrated into the power unit of the PwEMT. This brake-detent mechanism redundantly provides the patient on the cot and the operator a fail safe scheme to hold the platform at any one of many different cot elevations.

In another embodiment, an all solid state motor control circuit is provided to ensure reliable surge and run rate power to the gear motor as needed. The motor control circuit includes a voltage-doubling circuit selectable by the operator. The voltage-doubling circuit enables the operator to speed up folding the legs of the gurney to decrease cot height. This significantly lowers the time required to load the gurney into an ambulance or to lower the gurney to load a patient onto the platform.

The gurney of this invention provides a more efficient power drive to raise and lower the patient and thereby allows the use of either a lighter battery than heretofore possible for a given number of up/down cycles or allows a given weight battery to continue to be used but with more raising and lowering cycles.

This invention will be understood in accordance with the following written description taken together with the drawings.

DETAILED DESCRIPTION OF THE DRAWINGS

Figure 3A:
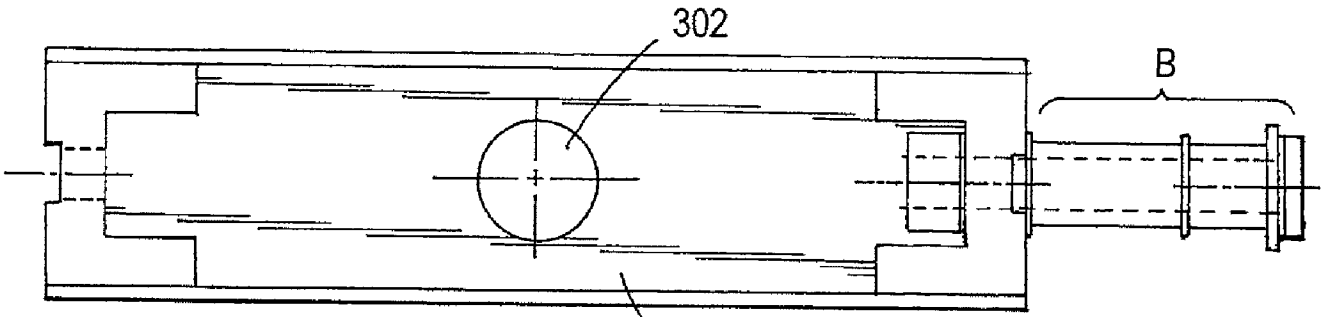
Figure 3C:
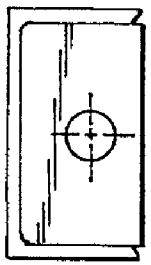
Figure 3B:
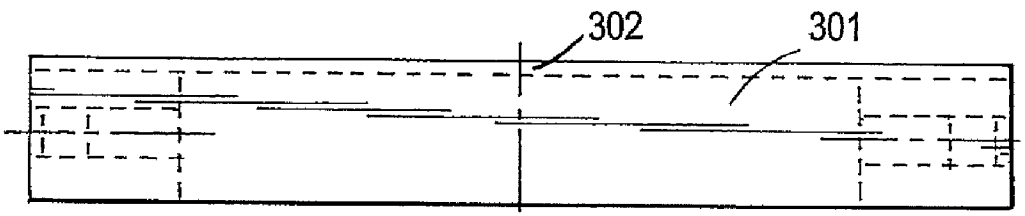

FIGS. 3*a* and 3*b* show end and top views, respectively, of the cross-beam below the cot (i.e. the patient-holding platform) and of the center hole in the cross-beam used with the raising and lowering structure of this invention to achieve a 92% or greater efficiency of motion using the ball screw and ball nut structure.

Figure 3D:
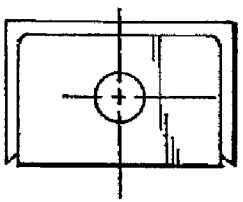

FIGS. 3*c* and 3*d* show side views of the end and top views of the cross-beam shown in FIGS. 3*a* and 3*b*.

Figure 4A:
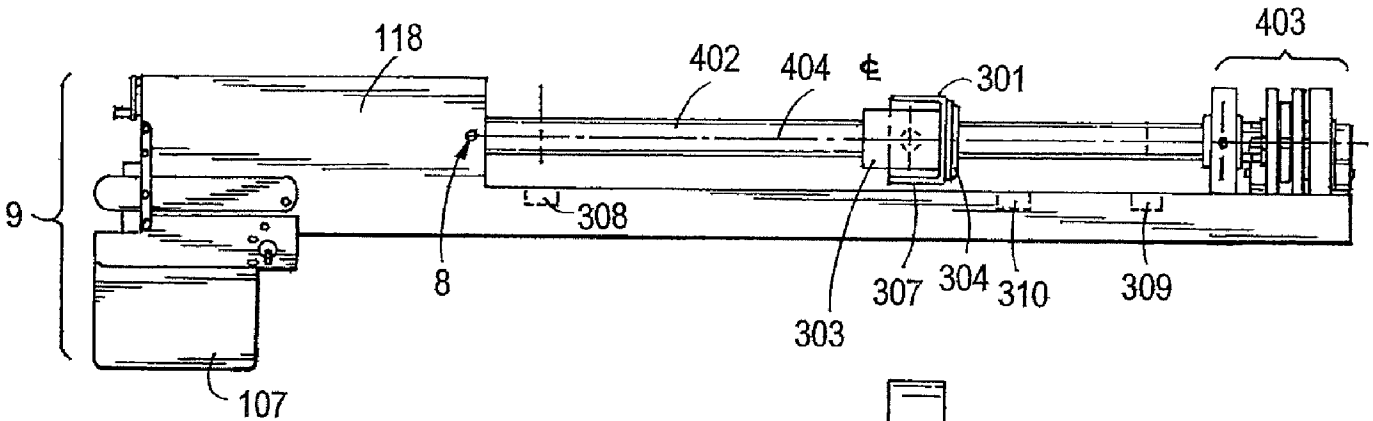
Figure 4B:
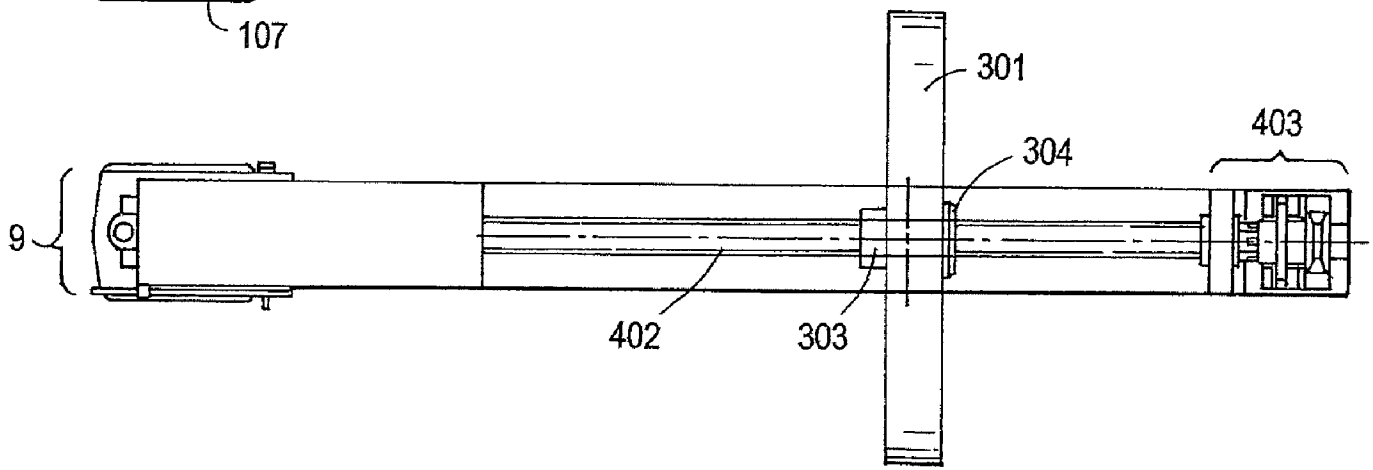

FIGS. 4*a* and 4*b* show a portion of the raising and lowering structure which operates with the cross-beam shown in FIGS. 3*a* to 3*d* as part of the power drive system which includes the motor and the brake mechanism of this invention.

Figure 5:
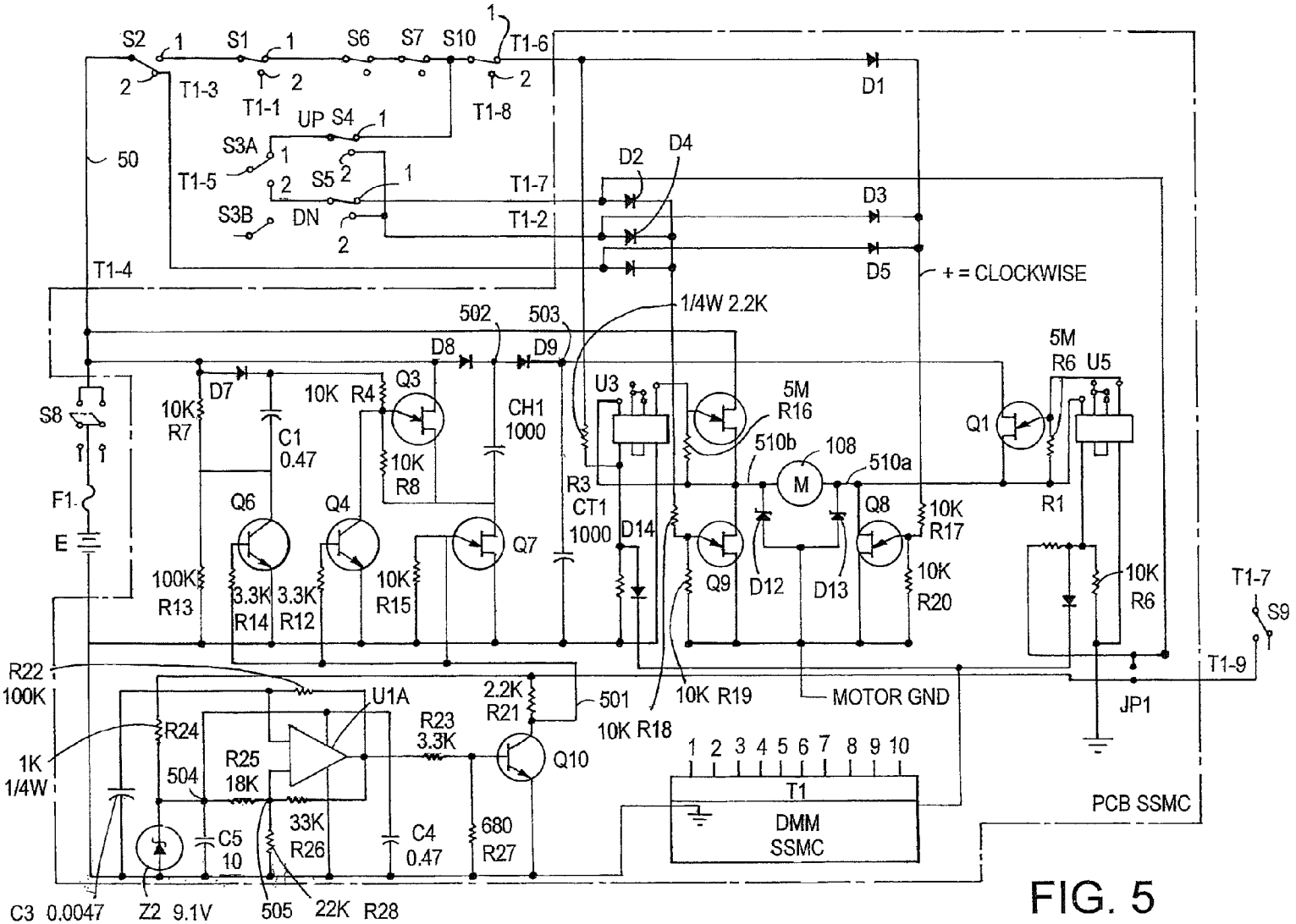

FIG. 5 shows the solid state motor control driving circuit of this invention.

Figure 6:
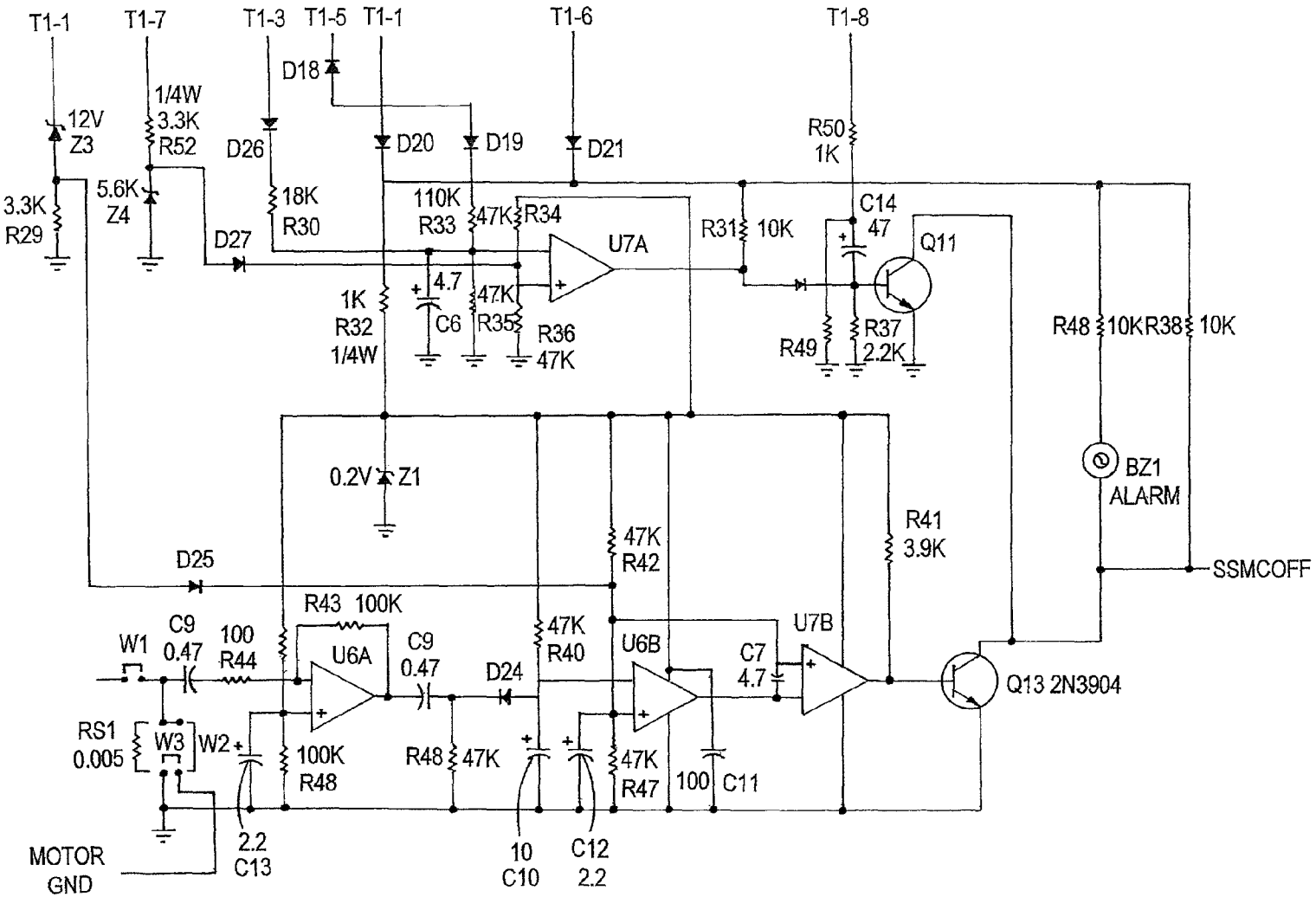

FIG. 6 shows in more detail the dynamic motor monitor and solid state motor control ("DMMSSMC") shown as a block in the circuit of FIG. 5.

Figure 1:
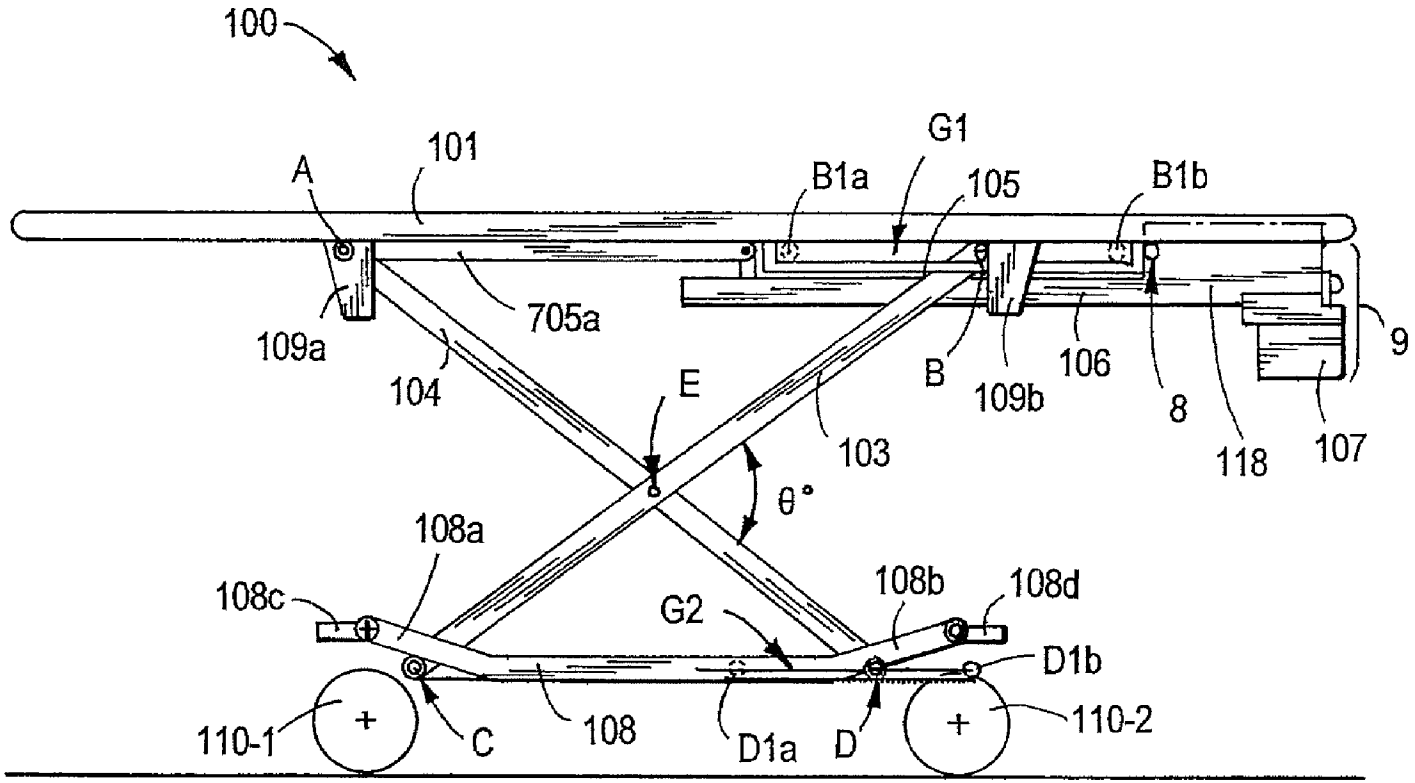
FIG. 1 shows a side view of the X frame gurney with the unique structure of this invention which improves the efficiency of raising and lowering the patient.
Figure 2:
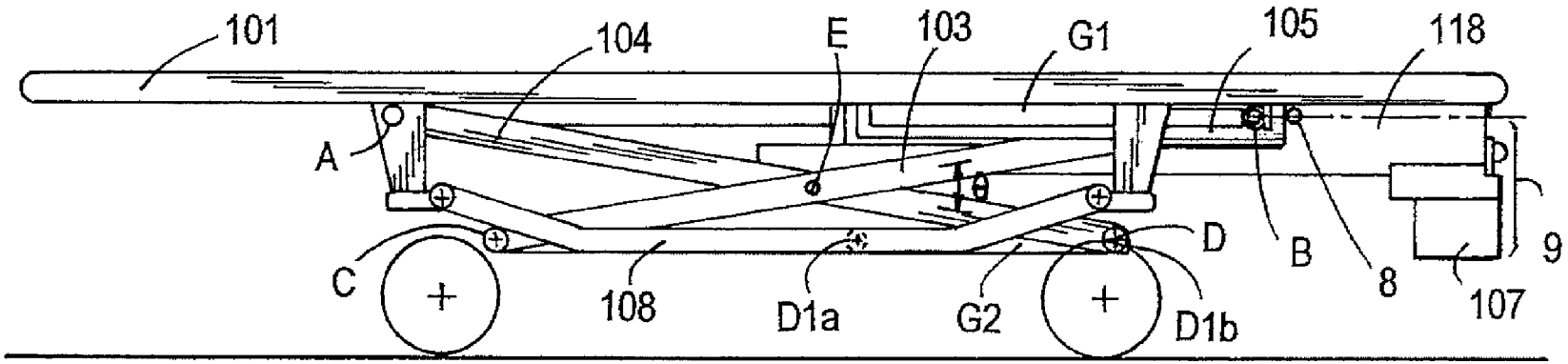
FIG. 2 shows the X frame gurney with the cot (i.e. platform) in the lowest elevation position (the patient load elevation).
Figure 7A:
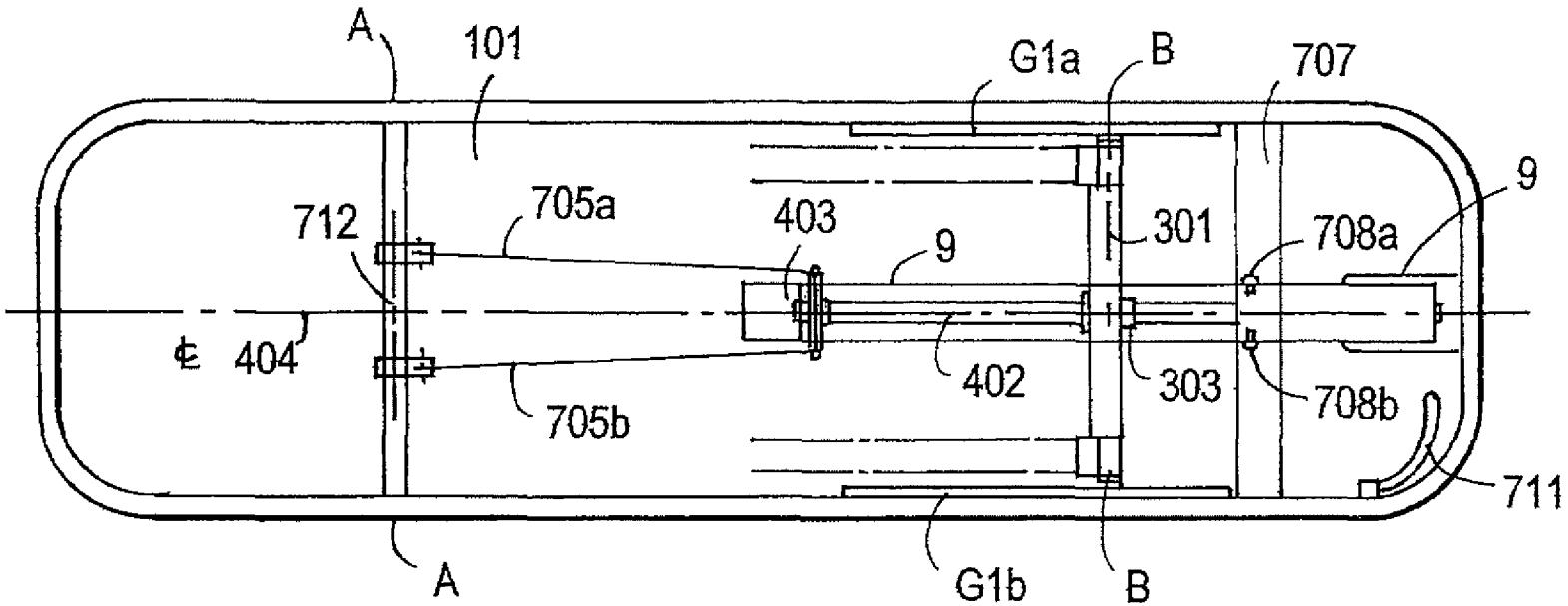

FIGS. 7*a*, 7*b*1, 7*b*2, 7*b*3, 7*b*4, 7*c*1, 7*c*2, 7*d*1 and 7*d*2 show respectively:

(i) the location of the brake detent mechanism 403 in relation to the raising and lowering structure (FIG. 7*a*), (ii) the details of the brake detent mechanism 403 including the ganged detent arms, the detent wheel 720, the brake arms and the brake wheel 741 (FIGS. 7*b*1, 7*b*2, 7*b*3 and 7*b*4), (iii) the details of the brake arms 740*a*, 740*b*, the brake wheel pulley 741 locked to the ball screw with the common brake/detent wheels, the keyway 742 and the flexible brake cable 743 used as the activating means (FIGS. 7*c*1, 7*c*2), and (iv) the ganged detent arms 760*a* and 760*b* on each side of the detent wheel 720 with stop rod 761 engaged in the detent wheel notch 764*a* and 764*c*, the detent wheel 720 locked in a ball screw with a common brake, detent keys keyway and with detent notches 764*a* to 764*d* located at 90° intervals around the detent wheel 720 and with damping pad 765 upon which the entire brake detent mechanism is mounted (FIGS. 7*d*1, 7*d*2).

DETAILED DESCRIPTION

Specific embodiments of this invention will now be described. These descriptions are meant to be illustrative only and not limiting. Those skilled in the art will envision other embodiments within the scope of this invention based on this description.

As shown in FIG. 1, the gurney 100 has its patient platform or cot 101 in a transport height position. The gurney 100 is capable of raising patient platform 101 to a higher position than shown in FIG. 1. The highest position of cot 101 will be attained when the bearing D at the lower end of arm 104 is in position D1*a* and bearing B on the topmost end of arm 103 is in position B1*a*. Bearing B is capable of sliding laterally from position B1*a* along groove G1, defined by U-shaped bearing guide 105, to position B1*b*. When this occurs, platform/cot 101 will be at its lowest position as shown in FIG. 2. In this position, bearing D on the lower end of arm 104 will be in position D1*b*. The relationship of bearing B to the guide 105 will be apparent from the structure of bearing B which is shown in more detail in FIGS. 3*a* and 7*a*.

It should be understood that the structure beneath platform 101 and shown in side view in FIGS. 1 and 2 is merely one-half of the actual structure used with a gurney 100. The arms 103 and 104 and frame 108 along with guide 105 and bearings B and D all have their counterparts on the back side of the gurney. For simplicity, these parallel structures are not being shown.

As shown in FIGS. 1 and 2, to change the height of platform 101, the bearings B and D at the ends of arms 103 and 104, respectively, must be moved. As shown in FIGS. 1 and 2, the head-end axle points of the X frame members 104 and 103, respectively, are A and C. Arms 104 and 103, respectively, pivot about these points A and C as the platform/cot 101 of gurney 100 is being raised or lowered. The foot-end axle bearings B and D at the ends of arms 103 and 104, respectively are movable pivot points. Bearing B moves in the guide G1 formed by guide rod 105 inline with points A and 8. Bearing D moves in a guide G2 formed with bottom cross-beam 108. Guide G2 is parallel to the guide G1 and is in line with pivot point C.

Referring to FIGS. 1 and 7*a*, it will be seen that the bearings B at the end of arms 103 are the driven movable points and points D at the ends of arms 104 are the follower movable points. To change the height of the X frame (which includes arms 103 and 104), the power unit 9 must move bearings B either toward or away from point A. Bearings D will follow suit and will move either toward or away from point C.

As bearings B are moved toward point A, the X frame height increases, platform 101 is raised and conversely as bearings B are driven away from point A, platform 101 is lowered. The lowest elevation of platform 101 is shown in FIG. 2.

As platform 101 elevation is decreased, the angle formed by the leg segments BE and ED gets smaller. The smallest angle θ occurs when the cot 101 is at its lowest point as shown in FIG. 2.

As platform 101 height is increased, the angle θ formed by the leg segments BE and ED increases and the force required to drive bearings B toward point A decreases.

The force required to drive point B toward point A to increase the height of platform 101 increases dramatically as the angle Θ (FIG. 1) formed by the elements BE and ED decreases and the platform 101 reaches its lowest height. The lowest height of platform 101 corresponds to the smallest angle θ between segments BE and ED. The smallest angle θ formed by the leg segments BE and ED is critical to the gear motor power required to raise platform 101 with the patient on it and thus to battery life.

The structure of this invention increases the minimum angle θ between arms BE and ED compared to prior structures by providing upwardly angled portions 108*a* and 108*b* (FIG. 1) at each end of beam 108. The normal pivot point C and end point D1*b* associated with a gurney in the prior art would have corresponded to the rest points for platform 101 when platform 101 was lowered. However, in accordance with this invention, upwardly angled segments 108*a* and 108*b* of horizontal frame 108 result in platform 100 resting upon extensions 108*c* and 108*d* extending horizontally from upwardly angled portions 108*a* and 108*b*. These horizontal extensions 108*c* and 108*d* are contacted by protrusions 109*a* and 109*b* extending downward from the frame of platform 101 such that as platform 101 reaches its lowest point, protrusions 109*a* and 109*b* rest respectively on extensions 108*c* and 108*d* thereby preventing platform 101 from being lowered any further. The angle θ that is formed by arms BE and ED when platform 101 has reached its lowest point is larger by several degrees than the angle θ associated with prior art gurneys. As a result, the power required to lift platform 101 with a patient is considerably less than in the prior art where arms EB and DE formed an angle θ of essentially zero degrees (0°). This increased angle has been achieved by lowering frame 108 relative to the wheels 110 of the gurney such that the platform 101 can still be lowered to the same elevation as prior art gurneys.

The gurney of this invention has the same footprint as prior art gurneys including the same wheel base and the same turning radius. However, because of the maintenance of the small non-zero minimum angle θ between arms BE and DE, the power required to raise platform 101 from its lowest position is substantially reduced.

Basically, the force required to drive bearings B toward point A over the range from the lowest elevation of platform 101 shown in FIG. 2 to the highest elevation shown in FIG. 1 and beyond is a square law function. Therefore, configuring the X frame of the gurney to have the largest angle θ possible when at the lowest elevation becomes one of the key performance criteria to achieve minimum power and maximum battery life.

The largest angle Θ possible for the lowest elevation shown in FIG. 2 is achieved and realized in the design of this invention without compromising wheel size, wheel base clearance, overall footprint and turning radius. To help achieve this result in the preferred embodiment, fixed length legs 103 and 104 are used. Telescoping legs when used require additional power to overcome friction in the telescoping legs. Telescoping legs can be used in this invention if desired but additional energy associated with telescoping legs will be required to raise or lower the gurney.

The height shown in FIG. 2 of platform 101 is typically the height used to load a patient onto the platform 101 or to store the gurney. The height of platform 101 in FIG. 1 is generally known as the transport height. This is the height typically used to roll the gurney with or without a patient from one location to another. The transport height is below the maximum height of platform 101.

As shown in FIGS. 1 and 2, the power unit 9 (including electric motor 118 and battery 107) is attached to the bottom of the cot platform 101. FIG. 7*a* shows in plan view the position of power unit 9 on the bottom of platform 101 relative to the movable cross-beam 301 and the threaded shaft 402 by means of which power is transmitted from the power unit 9 to the movable cross-beam 301 to raise or lower platform 101. Power unit 9 is attached to the head end axle 712, which is fixedly attached to the bottom of the head end of platform 101, by means of arms 705*a* and 705*b*. Each of arms 705*a* and 705*b* is connected at its distal end (relative to power unit 9) to axle 712 and at its proximal end to brake-detent mechanism 403. Mechanism 403 is fixedly attached to the bottom of platform 101 at an approximate midpoint. Power unit 9 is attached to the platform 101 at mounting points 708*a* and 708*b* on frame element 707 fixedly attached to the bottom of platform 101 near the foot end of the gurney. Guides G1*a* and G1*b* provide parallel guidance for the movable cross-beam 301. Opening 302 in cross-beam 301 (FIGS. 3*a* and 3*b*) contains interior-threaded nut 303 mounted in integrated ball bearing assembly 304 (FIGS. 4*a* and 4*b*), and through which passes threaded shaft 402 which when rotated moves cross-beam 301 to raise or lower platform 101 as discussed above. The operation of cross-beam 301, assembly 304 and shaft 402 is discussed below in conjunction with FIGS. 3*a* through 3*d*.

FIGS. 3*a*, 3*b*, 3*c* and 3*d* show respectively, the foot end view, the top view, the side view of the foot end view, and the side view of the top view of the cross-beam 301 which is movable relative to platform 101. As shown in FIG. 4*a*, assembly 304 in cross-beam 301, which extends completely through cross-beam 301, contains a nut 303 which is internally threaded. Assembly 304 is centered on horizontally extending longitudinal axis 404 (FIG. 4*a*). Threaded shaft 402 extends through nut 303 in assembly 304 along longitudinal axis 404 and is driven by motor 118 in power unit 9 to move the cross-beam 301 along the guides G1*a* and G1*b* (FIGS. 1, 2 and 7*a*). Cross-beam 301 has two bearings B, one attached at each end of cross-beam 301, (see FIG. 3*a*) to each of which one end of a corresponding arm 103 (FIGS. 1 and 2) is attached (for simplicity, only one such bearing B is shown in FIG. 3).

Threaded shaft 402 (FIGS. 4*a* and 4*b*) is rotated by motor 118 and thus pulls or pushes on cross-beam 301 (depending on the direction of rotation) by means of the external threads on shaft 402 rotatably mating with the internal threads on nut 303 in ball screw assembly 304 in cross-beam 301. Shaft 402 is approximately horizontal thereby ensuring the highest efficiency in raising and lowering platform 101. Movable cross-beam 301 is attached to the proximal end of each of arms 103 and slides along the guides (channels) G1*a* and G1*b* (FIGS. 1, 2 and 7*a*) between points B1*a* and B1*b* (FIG. 1). Shaft 402 can be removed from cross-beam 301 by removing the power unit 9 from the bottom of platform 101 and then rotating shaft 402 until it exits assembly 304 (see FIGS. 1, 2 and 7*a*) or by removing ball nut 303 and ball screw assembly 304 from crossbar 301 (FIGS. 4*a* and 4*b*).

FIGS. 4*a* and 4*b* show the location of bar 301 (viewed from the back side of the transporter shown in FIGS. 1 and 2) relative to the power unit 9, shaft 402 and detent/brake mechanism 403. Power unit 9 has an opening 8 on each side for mounting the power unit on the underlying frame of platform 101 at the foot end of platform 101. Shaft 402 is mounted preferably horizontally so as to provide a minimum-friction, straight alignment with assembly 304 centered in cross-beam 301. Horizontal alignment of the shaft 402 through the threaded opening in nut 303 mounted in assembly 304 in cross-beam 301 prevents these threads from pinching and thus makes more efficient the raising and lowering of platform 101 than if these structures are at an angle with the horizontal.

A brake detent mechanism 403 is shown to be located on the right hand portion of the structure in FIGS. 4*a* and 4*b*. Mechanism 403 is located in the middle underside of platform 101. Thus, FIGS. 4*a* and 4*b* show the side and plan views of the power unit 9, the ball screw 402 and ball nut 303 and ball nut assembly 304 centered symmetrically in cross-beam 301 for greatest efficiency. The top view of the power unit 9 shown in FIG. 4*b* shows the power unit centered symmetrically along the platform 101 structure. Cross-beam 301 with shaft assembly 402 and bearing B (FIGS. 3*a* to 3*d*) illustrates the simplicity of this structure.

In FIGS. 1 and 2, point E is the pivot point of the X configured arms 103 and 104 for their rotation relative to each other. Bearings B are driven by the power unit 9 rotating the ball screw 402 (FIGS. 4*a* and 4*b*) in ball nut 303 in assembly 304 mounted in cross-beam 301. The result is to slide cross-beam 301 and the two bearings B along guide G1*a* and G1*b* (FIG. 7*a*) thereby to either raise or lower the platform 101 as described above. Due to the linear horizontal arrangement of the ball screw 402, ball nut 303 and assembly 304, the efficiency of this structure is 90% or greater if the force applied and delivered to the load is centered on the ball screw axis 404 and not off center or titled to one side or the other. An off-center relationship between the shaft 402 and the ball nut assembly 304 creates additional friction and reduces the efficiency of raising and lowering platform 101.

The integrated ball screw 402, assembly 304 and cross-beam 301 structure ensures that the rotary force applied by the gear motor 9 to the ball screw 402 results in a linear thrust along the axis 404 of the ball screw 402 to a load that is balanced. This ensures maximum efficiency in raising and lowering platform 101. Referring both to FIGS. 1 and 7*a*, it can be seen that points A, B, 708*a* and 708*b* are all in line and true (i.e. parallel or perpendicular) to the axis 404 of the ball screw 402.

To improve the efficiency of raising and lowering cot platform 101, the ball nut assembly 304 by which the load on platform 101 is driven up or down, is physically coupled to the ball screw 402 through a large number of ball bearings. The ball screw 402 and the ball nut 303 in assembly 304 have matching groove threads in which the ball bearings roll. The ball bearings have a return path near a ball nut internal or even an external channel that results in an endless rolling train of ball bearings. The use of these ball bearings in conjunction with the mating threads greatly improves the efficiency of raising and lowering platform 101. An appropriate ball bearing assembly 304 is made by BSA (Ball Screws and Actuators Company, 3616 Snell Avenue, San Jose, Calif. 95136).

Rotary force of the gear motor 108 is applied to the ball screw 402 and is evenly distributed through the ball bearings in the ball nut assembly 304 and thereby to the load as long as the load that is directly coupled to the ball nut 303 is centered and true to the axis of the ball screw 402. This alignment improves the efficiency of the ball screw 402-ball nut 303 mechanism over non-aligned structures. If the load is not centered and true to (i.e. in line with) the lateral axis of the ball screw 402, then the rotary force of gear motor 108 is not evenly distributed through all of the ball bearings. In fact, some ball bearings may be pushed to the point of binding while others may not bear any part of the load. Consequently, the efficiency of the ball screw 402-ball nut 303 mechanism will be dramatically reduced. The arrangement of the integrated ball screw 402-cross-beam 301 alignment with bearings B and points A, 708*a* and 708*b* as shown in FIGS. 1, 2 and 7*a*, along with the alignment of the structures with the shaft roller guides G1*a* and G1*b* installed on the gurney frame (FIGS. 1 and 2) all ensure that the load is true and centered to the axis 404 of the ball screw 402 for both raising and lowering platform 101.

This integrated ball screw 402-cross-beam 301 structure with the load true-centered along the axis 404 of the ball screw 402, is an important factor in realizing an effective and efficient power unit for converting rotary force to linear force.

Brake detent mechanism 403 is shown centered under the platform 101 in FIG. 7*a*. The top view in FIG. 7*b*1 of the brake detent mechanism 403 shows the detent wheel 720, the ganged detent arms 760*b*1 and 760*b*2 (arms 760*a*1 and 760*a*2 are visible in FIG. 7*b*2 on the patient left side of the detent wheel 720 but are omitted in. FIG. 7*b*1 to avoid cluttering the drawing), and the brake wheel 741 (which in one embodiment can be stopped by brake arms 740*a* and 740*b* as shown in FIGS. 7*b*1, 7*b*2 and 7*c*1.).

FIGS. 7*c*1 and 7*c*2 show details of the brake wheel arms 740*a* and 740*b*, and the brake wheel pulley 741 locked to the ball screw 402 by means of a key in keyway 742 with a flexible brake cable 743 to activate the brake. FIG. 7*c*1 shows brake wheel arms 740*a* and 740*b* from the right end view in FIG. 7*b*1. FIG. 7*d*1 (the end view from the right of the brake detent mechanism 403 in FIG. 7*b*1 with the brake wheel arms 740*a* and 740*b* removed) shows two detent arms 760*a*2 and 760*b*2. The two sets of detent arms 760*a*1-760*b*1 and 760*a*2-760*b*2 are held together at the top by spring 766*a* (not shown) and 766*b* (FIG. 7*d*1), respectively. In order to release stop rod 761*a* and stop rod 761*b* (diametrically opposed to rod 761*a* but not shown for simplicity (FIG. 7*d*1)), a cable is pulled by the operator reaching under the gurney platform and squeezing on handle 711 (FIG. 7*a*) to bring handle 711 toward the frame of platform 101. This squeezing of lever 711 causes the top portions of detent arms 760*a*1-760*b*1 and 760*a*2-760*b*2 to move apart by stretching the springs 766*a* and 766*b*. The stretching of the springs releases the stop rods 761*a* and 761*b* and thereby allows shaft 402 to rotate and thus move the ball nut assembly 304 along shaft 402 to raise or lower platform 101.

The squeezing of handle 711 also results in the brake arms 740*a* and 740*b* (FIGS. 7*b*1, 7*b*2, 7*b*3 and 7*c*1) moving out of the groove in brake wheel pulley 741 and thereby stretching spring 746 (FIG. 7*b*3) freeing up brake wheel pulley 741 to also rotate. Thus, this invention uses two safety mechanisms to ensure that platform 101 remains at a selected elevation: namely, the detent arms 760 and the brake arms 740 together with the detent wheel 720 and the brake wheel pulley 741. This feature is important. Should the motor 108 or the battery 107 fail, the gurney will automatically lock platform 101 at its then elevation. Thus, the gurney has an important fail safe mechanism, the four detent arms 760 and the two brake arms 740.

Of importance, each brake arm 740*a* and 740*b* has on its interior surface for engaging with the groove of the pulley 741, portions of a v belt that would normally be used to rotate the pulley 741. This ensures that the surfaces of arms 740*a* and 740*b* that contact the interior channel of the brake wheel pulley 741 prevent brake wheel pulley 741 from rotating. Thus, until flexible brake cable 743 is pulled by the gurney operator squeezing on handle 711, platform 101 cannot be raised or lowered.

When brake cable 743 is pulled, not only do brake arms 740*a* and 740*b* pivot about their pivot points 744*a* and 744*b* in brake base 744 to release brake wheel pulley 741 but detent arms 760*a*1-760*b*1 and 760*a*2-760*b*2 also pivot about their pivot points 765*a* and 765*b* (FIG. 7*d*1). This removes stop rods 761*a* and 761*b* (not shown for simplicity) from their respective notches 764*a* and 764*c* (not shown in FIG. 7*d*1 for simplicity but diametrically opposed to notch 764*a*) in detent wheel 720 thereby allowing platform 101 to be raised or lowered.

FIG. 7*d*1 shows details of the ganged detent arms 760*a* and 760*b* on each side of the detent wheel 760. Detent stop rod 761*a* is also shown along with a keyway 763 which locks the detent wheel 720 to the ball screw 402. The detent notch 764*a* in which stop rod 761*a* is placed is one of four such notches 764*a* to 764*d* located at 90° intervals around detent wheel 720. The orthogonal notches located at positions A, B, C and D spaced 90° around detent wheel 720 provide in one revolution four possible locked positions resulting in fine resolution of the elevation of platform 101 (in this case 1/16th inch vertical resolution). Because of the unique locking mechanism associated with this gurney, the operator is able to safely lock the gurney so that platform 101 is at the desired elevation within 1/16" resolution. In this situation, ball screw 402 is prevented from rotating and therefore cross beam 301, is prevented from moving in either direction along the ball screw 402.

Damping pad 765 upon which the entire brake detent mechanism 403 is mounted is also shown in FIG. 7*d*1. In operation when the operator's hands are off the gurney and particularly not squeezing handle 711 (FIG. 7*a*), platform 101 is stationary at a fixed height and the brake wheel pulley 741 and the detent wheel 720 are motionless, locked in a fail-safe position as described above.

Solid State Motor Control Circuit (SSMC)

FIG. 5 shows the circuit schematic for the motor driving circuit which includes a voltage doubling circuit utilizing a square wave oscillator. FIG. 5 also shows the dynamic motor monitor (DMM) solid state motor control (SSMC) as a block diagram. The dynamic motor solid state motor control (DMM SSMC) is shown in schematic detail in FIG. 6. The motor driving circuit includes transistors Q1 through Q9 as well as photocoupler elements U3 and U5.

A square wave oscillator used under some circumstances to increase the voltage applied to motor 118, includes differential amplifier U1A and transistor Q10.

The operator uses switch S2, S3A (S3B is a spare switch), S8 and S9 to control the performance of the motor driving circuit in FIG. 5. Switch S8 is the master on-off switch for the entire system. Switch S9 is the on-off switch for the square wave oscillator circuit.

The performance of a previous version of the dynamic motor monitor, solid state control circuit shown in FIG. 6 has been described in U.S. Pat. No. 5,887,302 issued Mar. 30, 1999 to Vito A. DiMucci and Michael V. DiMucci. However, one difference between the circuit described in the '302 patent and the circuit in FIG. 6 is the input line T1-8. A step function increase in voltage applied on input lead T1-8 when switch S10 connects to contact 2 pulses NPN transistor Q11 (FIG. 6) on for a period of time related to the time necessary to charge capacitor C14 through 2.2K ohm resistor R37. The node between resistor R37 and series-connected capacitor C14 is connected to the base of NPN transistor Q11. Initially, when a voltage is applied to lead T1-8, the full voltage drop is taken across R37 and is applied to the base of NPN transistor Q11 thereby turning on NPN transistor Q11. Turning on NPN transistor Q11 pulls the voltage on output lead SSMCOFF low. This low voltage is then applied through diodes D10 and D14 (FIG. 5) and photocouplers U3 and U5 to turn off NMOS transistors Q1 and Q5 and thereby to shut off motor 118 for the time that transistor Q11 remains on. Switch S10 is caused to connect to contact 2 when platform 101 reaches its maximum height thereby shutting off the motor.

This added feature enables the system to provide the operator an audible signal from sound source BZ1 of an optional stop in motor drive 118 indicating, for example, that platform 101 has reached the transport height.

The Motor Driving Circuit

The motor driving circuit comprises the H bridge formed by NMOS transistors Q1, Q5, Q8 and Q9 in FIG. 5 together with the voltage multiplying circuit formed by NMOS transistors Q3 and Q7 and NPN transistors Q4 and Q6 also in FIG. 5. The high side control of motor 118 (the applied voltage side) is enabled by signals applied through U3 to Q5 and through U5 to Q1. The low side control of motor 118 (ground return side) is enabled through NMOS transistors Q8 and Q9.

By closing switch S8, the battery voltage E is directly connected to the drain of NMOS transistor Q5 thereby providing full battery voltage across Q5 at all times. Note, however, that with the circuit disclosed only the full battery voltage can be applied to the drain of Q5; it is not possible to apply the doubled voltage (to be described below) to the drain of Q5. This prevents a doubled voltage from being used to raise platform 101 and thus prevents a power overload from occurring when a heavy patient is being raised on the gurney. If desired, the circuit can be modified to allow an increased voltage to be used to raise platform 101.

Increasing Cot Height

To increase the height of platform 101, the operator sets switch S3A in the up position (i.e. S3A connects through contact 1 to S4 which in turn connects to the node between S7 and S10). The operator then squeezes the control handle 711 (FIG. 7*a*) thereby turning on NMOS transistors Q5 and Q8 by a high voltage on lead T1-6 applied to the gates of Q5 and Q8 via photocoupler U3 and diode D1, respectively. Early in the squeezing process, switch S2 connects to S1 which in turn connects to pole 2 thereby applying the battery voltage E through lead T1-1 to lead T1-5 (FIG. 6). The full battery voltage E is applied to lead 510*b* of the gear motor 118 via switch S8 and lead T1-4 through Q5. Simultaneously, the brake arms 740*a* and 740*b* are moved away from the brake wheel pulley 741. Motor 118 rotates counterclockwise to drive up platform 101. This frees and clears two of the detent rods 761*a* to 761*d* from two diametrically opposed detent notches 764*a*-764*d* thereby enabling the detent arms 760 to be pulled away from the detent wheel 720. As the operator continues to squeeze the control handle 711 (FIG. 7*a*) the reed switch S1 is activated and connects through pole 2 to lead T1-1 disconnecting from S6. T1-1 connects through diode D18 (FIG. 6) to lead T1-5 (FIGS. 6 and 5) and then to switch S3A. Since the operator has elected to raise platform 101, switch S3A is connected through contact 1 to switch S4 and then through switch S10 to line T1-6 thereby reactivating transistors Q5 and Q8. The full battery voltage is reapplied to lead 510*b* of gear motor 118 through Q5. Q8, turned on by the voltage on lead T1-6, connects lead 510*a* from motor 118 to motor ground. Therefore, motor 118 rotates counterclockwise to raise platform 101.

The gear motor 108 will continue to drive up platform 101 until one of the following occurs:

(a) the operator releases the control handle 711 thereby stopping the action;

(b) the transport height sensor S10 is reached stopping the action; or (c) the maximum height sensor S4 is reached stopping the action.

Transport height is below maximum height. When cot platform 101 reaches transport height, a beep occurs from alarm BZ1 and if the operator releases handle 711, the platform stays at the transport height. If the operator then squeezes the handle again platform 101 rises to the highest position, and is stopped by S4.

The sequential details of stopping the action and engaging the brake and the detent rods into the detent notches are described above in the brake detent mechanism description operation.

Decreasing Cot Height

To decrease the height of cot platform 101, the operator sets switch S3A in the down position (i.e. switch S3A connects through contact 2 to switch S5). The operator then squeezes the control handle 711 (FIG. 7*a*) and activates switch S2. Early in the squeezing process, switch S2 connects through contact 1 to switch S1 thereby enabling NMOS transistors Q5 and Q8 via U3 and D1, respectively. The full battery voltage E is applied to the gear motor 118 via switch S8 and lead T1-4 through Q5 to lead 510*b*. Simultaneously, the brake arms 740*a* and 740*b* are pulled away from the brake wheel 741. This drives motor 108 counterclockwise to raise platform 101. This frees and clears the detent rods 761 from two of the detent notches 764*a* to 764*d* enabling the detent arms 760 to be pulled away from the detent wheel 720.

As the operator continues to squeeze the control handle, the run switch S1 is activated and connects through contact 2 to lead T1-1, disconnecting from S6. T1-1 connects to switch S3A via diode D18 (FIG. 6) and lead T1-5 (FIGS. 6 and 5). Since the operator elected to drive the cot down, switch S3A is connected to switch S5 and then on to line T1-7 and thereby activates through photocoupler U5 and diode D2, respectively, transistors Q1 and Q9. The battery voltage applied to the gear motor 118 is determined by whether or not the voltage doubling circuit is activated.

If the voltage doubling circuit is not activated, the voltage applied to the gear motor 118 on lead 510*a* via Q1 is via the path from E through diodes D8 and D9 to Q1 drain D. This voltage level enables decreasing the height of platform 101 at a normal rate.

If the voltage doubling circuit is activated, the voltage applied to the gear motor 118 via Q1 is via the voltage doubling circuit including NPN transistors Q6 and Q4 and NMOS transistors Q3 and Q7. The output voltage from this circuit is applied through diode D9 and NMOS transistor Q1 to lead 510*a*. The increased voltage applied through Q1 causes the gear motor to run at an accelerated rate, approximately 1.5 to 1.8 times faster. This speed increase causes platform 101 to lower (i.e., fold legs 103 and 104) very quickly. This feature is especially useful when the operator is loading a cot into an ambulance where the legs 103 and 104 must be folded up under the bottom of cot platform 101 to allow the gurney to be rolled into the ambulance.

In either case, voltage doubling circuit off or on, the gear motor 118 will continue to drive the cot down until one of the following occurs:

(a) The operator releases the control handle 711 (FIG. 7*a*) thereby stopping the action; or (b) The minimum height sensor S5 is reached stopping the action.

The sequential details of stopping the action and engaging the brake and detent rod 761*a* and 761*b* into two diametrically opposed of the detent wheel notches 764*a* through 764*d* are as described above.

Voltage Doubling Circuit

The voltage doubling circuit shown in FIG. 5 comprises charge pump transistors Q3, Q4, Q6 and Q7 and the associated circuitry and the square wave oscillator including amplifier U1A and NPN transistor Q10 (oscillator output driver transistor) and associated circuitry. When the oscillator is activated, this circuitry approximately doubles the voltage from the battery applied to motor 118. The square wave oscillator amplifier (U1A) and the oscillator output driver transistor Q10 control the charge pump operation. The oscillator cycles control the on-off sequences of the charge actions of capacitors C1 and CH1 and the doubled output voltage sent via diode D9 to capacitor CT1 and lead 510*a* of motor 118 via transistor Q1.

When the voltage doubling circuit is activated by setting switch S9 to provide the high voltage on lead T1-7 to lead T1-9, NPN transistor Q10 is off so the collector of NPN transistor Q10 is at a positive voltage and NPN transistors Q6 and Q4 and NMOS transistor Q7 fully conduct resulting in the collectors of Q6 and Q4 approaching system ground or zero volts. The drain of Q7 also approaches zero volts. Capacitor C1 is then charged to the full voltage E less VD7, the voltage drop across forward-biased diode D7. Capacitor CH1 is charged to voltage E less VD8, the voltage drop across forward-biased diode D8. The high voltage on lead T1-9 causes amplifier U1A to produce a high level output signal to turn on NPN transistor Q10.

Before the first cycle of activating the voltage doubling circuit, capacitor CT1 has been charged to the voltage E less VD8+VD9, the voltage drops across the two series-connected, forward-biased diodes D8 and D9.

When the oscillator changes state, that is, when the output signal from amplifier/oscillator U1A goes high, Q10 turns on and the voltage on the collector of Q10 becomes approximately zero volts. Consequently, transistors Q4, Q6 and Q7 turn off. Immediately, the collector of Q6 rises almost to voltage E as a result of the voltage from battery E being applied through series connected resistors R7 and R13 of 10K and 100K ohms, respectively.

The positive terminal (+ terminal) of capacitor C1 rises to the voltage approximately E+E less VD7 (that is 2E less the voltage drop across forward biased diode D7). Diode D7 is reversed biased and off but N channel MOS transistor Q3 is turned on by the positive voltage on its gate. Q3 is fully conducting and drives the drain of Q7 to a high voltage, namely approximately the battery voltage E.

The positive (+) terminal of capacitor CHI immediately rises to battery voltage E plus E less VD8, the voltage drop across forward biased diode D8. Thus, the voltage on node 502 is now 2E less VD8. Diode D9 fully conducts current to charge the capacitor CT1 to 2E less (VD8 and VD9). Lead 510*a* of motor 118 now receives through NMOS transistor Q1 the voltage level 2E less (VD8 plus VD9) (i.e. 2E−VD8−VD9). NMOS transistor Q1 is turned on by a positive voltage on its gate from lead T1-7 transmitted through photocoupler U5.

Each cycle of the square wave oscillator produces an output signal on the output lead 501 from the collector of NPN transistor Q10. The high level signal on output lead 501 is followed by a low level signal to comprise one cycle of the square wave oscillator. As the next cycle starts, the output signal on lead 501 from NPN transistor Q10 goes high, and the sequence of events described above repeats. The charge on capacitor CT1 goes to a voltage level of E minus (VD8+VD9). Diode D9 will conduct the charge to capacitor CT1 and the voltage on capacitor CT1 will drive the gear motor 118 when the voltage presented to it is 2E minus VD8. Repetitive cycles replenish the charge on capacitor CT1 and maintain the voltage supplied to the gear motor 118 at approximately the level of 2E minus (VD8+VD9) thus maintaining the voltage doubling process and applying approximately double the voltage of battery E to motor 118.

The oscillator frequency affects the Voltage droop that occurs during the Q10 high output half cycle. Increasing the value of CT1 will reduce the droop. Also increasing the oscillator frequency will reduce the droop. Generally using both of these techniques will assist in maintaining the desired approximately doubled voltage on the motor 108.

The voltage doubling circuit provides an effective all solid state means to speed up decreasing the height (i.e. folding the legs) of the gurney to the lowest profile as shown in FIG. 2. This enables rapid loading of the gurney with the patient into an ambulance and thereby reduces stress and strain on the part of operators.

In FIG. 6, the differential amplifier U6A, together with the diode D24, differential amplifier U6B, differential amplifier U7B, NPN transistor Q13 and associated circuitry, function as described in U.S. Pat. No. 5,887,302 to shut off the motor 118. The operation of this circuit is described in the '302 patent and thus the '302 patent is hereby incorporated by reference in its entirety in this application Other embodiments of this invention will be obvious in view of the above description. In particular, an embodiment which increases the voltage applied to the drive motor from the normal voltage so applied to increase the speed at which the platform is raised will also be obvious in view of this disclosure. This description is illustrative only and not limiting.

What is claimed is:

1. A gurney comprising:

a platform for holding a patient;

a frame;

first and second X-frame structures each attached between one side of said platform and a corresponding side of said frame to allow said platform to be raised or lowered, each X-frame structure having (a) a first arm pivoted at one end to said frame and being coupled at the other end to a bearing that slides along a first guide rail attached to said platform; and (b) a second arm pivoted at one end to said platform and being coupled at the other end to a bearing that slides along a second guide rail attached to said frame;

a motor;

a circuit which receives an input voltage for driving the motor;

a ball screw threaded shaft driven by said motor;

an interior threaded ball nut threadably engaged with said ball screw threaded shaft and mounted in an integrated ball bearing, nut and screw assembly; and a cross-beam that is mechanically coupled to both said integrated bearing, nut and screw assembly and each of said first and second X-frame structures, so as to transmit a rotational motion of said ball screw threaded shaft to sliding motion of said bearings along said first and second guide rails in each of said first and said X-frame structures, wherein a longitudinal axis of the ball screw threaded shaft and said integrated ball bearing, ball and nut assembly pass through an opening through said cross-beam, said opening being symmetrically centered both horizontally and vertically in said cross-beam which is secured to said integrated ball bearing, ball and nut assembly.

2. A gurney as in claim 1 further including corresponding threaded grooves between said threaded ball nut and said threaded shaft, and ball bearings in the integrated ball bearing assembly positioned along the threaded grooves to reduce friction between said shaft and said nut.

3. A gurney comprising:

a frame including wheels for allowing said gurney to be moved;

a platform adjustably mounted relative to said frame thereby to allow the distance of said platform from said frame to be adjusted by moving a cross-beam that slides along parallel guide rails secured to said platform;

a drive mechanism attached to said cross beam including:

a ball screw threaded shaft;

an interior ball nut threadably engaged with said ball screw threaded shaft, said interior ball nut moving along said ball screw threaded shaft when said ball screw threaded shaft is rotated and being connected so as to change the distance of said platform from said frame through movement of said cross-beam when said ball screw threaded shaft is rotated;

threaded grooves between said threaded interior ball nut and said ball screw threaded shaft; and ball bearings positioned along the threaded grooves to reduce friction between said threaded ball screw shaft and said threaded ball nut;

the gurney including a motor for rotating said threaded ball screw shaft relative to said interior ball nut thereby to adjust the height of the platform relative to said frame, and a circuit which receives an input voltage for driving the motor at an applied voltage; and a rotary brake detent locking mechanism operably connected to said ball screw threaded shaft, said rotary brake detent locking mechanism comprising a detent mechanism and a braking mechanism that are both coaxially mounted to engage said ball screw threaded shaft, so as to allow the platform to be locked in any one of a selected number of positions.

4. A gurney as in claim 3 wherein said mechanism comprises a detent structure integrally engaged with said threaded ball screw shaft thereby to prevent said threaded ball screw shaft from rotating when said drive motor is quiescent.

5. A gurney as in claim 3 wherein said threaded ball screw shaft is linearly mounted to said parallel guide rails secured to said platform thereby to minimize the energy required to adjust the platform relative to said frame.

6. A gurney as in claim 5 including two sets of X-connected rotatable arms, said X-connected arms being connected between said platform and said frame to allow the height of said platform to be adjusted relative to the frame, said X-connected arms having a minimum non-zero angle beneath which the arms cannot be rotated thereby to reduce the power consumed in raising the platform from its lowest position relative to the frame compared to the power consumed when said angle is zero.

* * * * *